US007503081B2

(12) United States Patent
Montgomery

(10) Patent No.: US 7,503,081 B2
(45) Date of Patent: Mar. 17, 2009

(54) MULTIFUNCTIONAL ODOR-FREE, WATER-SAVING, CLOG-FREE, ENVIRONMENTALLY FRIENDLY TOILET

(76) Inventor: Robert D. Montgomery, 1685 W. 12th St., Reno, NV (US) 89503

( * ) Notice: Subject to any disclaimer, the term of this patent is extended or adjusted under 35 U.S.C. 154(b) by 516 days.

(21) Appl. No.: 11/320,202

(22) Filed: Dec. 28, 2005

(65) Prior Publication Data

US 2007/0143909 A1 Jun. 28, 2007

(51) Int. Cl.
*E03D 11/00* (2006.01)

(52) U.S. Cl. ..... 4/254; 4/213

(58) Field of Classification Search ..... 4/213, 4/216, 217, 254, 422
See application file for complete search history.

(56) References Cited

U.S. PATENT DOCUMENTS 4,882,791 A * 11/1989 Kimes ..... 4/254
5,561,872 A * 10/1996 Phillips ..... 4/667
6,311,341 B1 * 11/2001 Zwezdaryk ..... 4/254
2004/0231035 A1 * 11/2004 Ciotic ..... 4/213

* cited by examiner

*Primary Examiner*—Charles E Phillips

(57) ABSTRACT

A toilet having improved flush capabilities, an electrical system for foul air evacuation including bacterial filtration, a storage compartment, a night light, improved waste disposal, and optional accessories for converting the toilet into a medical work-station for ease of use by patients and/or the handicapped.

27 Claims, 5 Drawing Sheets

MULTIFUNCTIONAL ODOR-FREE, WATER-SAVING, CLOG-FREE, ENVIRONMENTALLY FRIENDLY TOILET

FIELD OF THE INVENTION

This invention relates in general to toilets but more particularly to a multifunctional toilet having improved flush capabilities, an electrical system for foul air evacuation including bacterial filtration, a storage compartment, a night light, improved waste disposal, and optional accessories for converting the toilet into a medical work-station for ease of use by patients and/or the handicapped.

BACKGROUND OF THE INVENTION

Toilets in general have existed for an extremely long period of time and many varieties and options have been suggested and taught within the known prior art. For example, some varieties include macerators, foul air evacuation means, improved water conservation means, automatic cleansing means, etc. All of which have proven to be most useful but each have inherent disadvantages and drawbacks that the present invention recognizes, addresses and resolves in a manner heretofore not taught within the known prior art.

Within the prior art, most toilets that include macerators or the like are specifically designed for use within toilet facilities located on marine vessels, motor homes, and the like. The general purpose of which is to macerate waste materials from the toilet so as to facilitate disposal thereafter before being deposited into the water or other disposal site. Thus reducing unsightly debris or pollution associated therewith. However, it would be advantageous to provide an improved toilet having a waste destruction apparatus that is usable with any conventional toilet so as to destroy any debris being deposited therein. For example, there are many items that are sometimes deposited into a toilet including diapers, sanitary napkins, tampons, ostomy bags, etc. and such items most often cause clogging of the system. More importantly such items are very unsanitary and if not properly disposed of can easily cause diseases and the like. Therefore it is very important to have an environmentally safe and friendly means for proper disposal thereof and which heretofore has not been successfully achieved.

Furthermore, within the known prior art there have been numerous attempts to provide foul air evacuation means, as foul air associated with most toilet facilities is a real problem that must be addressed and resolved. Such prior art attempts include extremely complicated systems and are not cost effective or truly functional. Within such systems the toilet facility must be modified including additional piping, electricity outlets, venting, expensive blowers, filters, motors, etc. More importantly such systems heretofore all exhaust the foul odors outwardly from within the toilet facility into the outside air. This is truly not advantageous as such foul air often contains bacteria and microorganisms that are air-bourn and can easily cause serious infection and diseases. Therefore this is clearly not a safe or acceptable manner for foul air evacuation and such systems must be recognized, addressed and eliminated from use for environmental safety and health reasons.

Still further disadvantages and drawbacks associated with the prior art include the fact that none are functional for use by large and/or handicapped individuals as none are variable in size, height and/or adjustable for use by various users having unique needs. Also, none of the prior art toilets address, recognize and/or resolve issues associated with users having specific needs such as ostomy patients and the like.

OBJECTS AND ADVANTAGES OF THE PRESENT INVENTION

It is therefore a primary object of the present invention to provide a new and improved multiuse/multifunctional toilet that has numerous advantages and novel aspects that have not been recognized, addressed and/or resolved within the known prior art.

It is another object of the present invention to provide a new and improved multiuse/multifunctional toilet that is useable by various individuals each having unique or specialized needs.

Yet it is another object of the present invention is to provide a new and improved multiuse/multifunctional toilet that is environmentally friendly, conserves water, odor-free and clog-free, respectively.

Still a further object of the present invention is to provide a new and improved multiuse/multifunctional toilet that includes numerous options and/or accessories in combination that heretofore have not been taught within the known prior art.

Other objects and advantages will be seen when taken into consideration with the following drawings and specification.

DETAILED DESCRIPTION OF THE DRAWINGS

Figure 1:
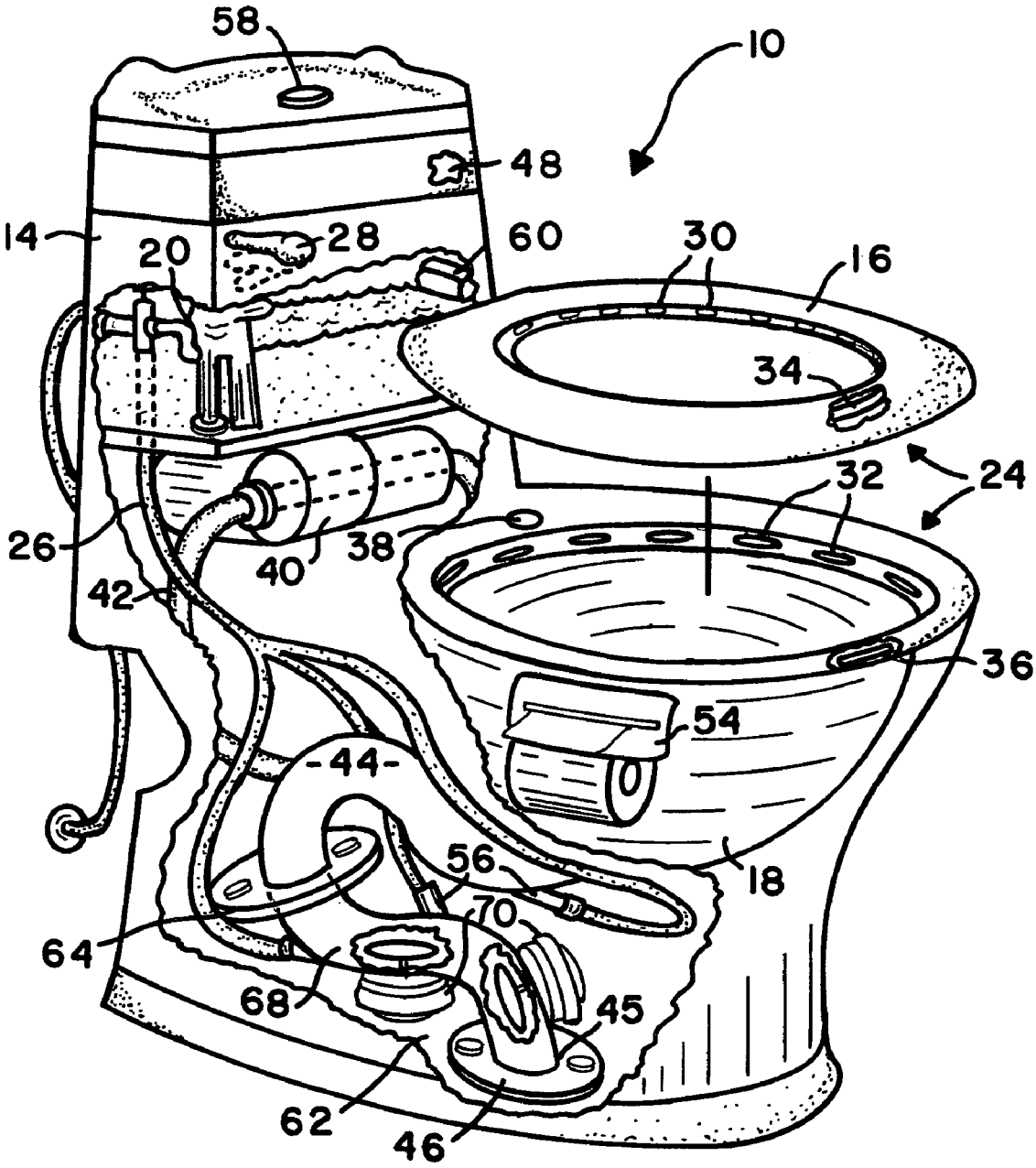
FIG. 1 is substantially an overview of a first embodiment for the present invention.

Referring now in general to the drawings wherein like characters refer to like elements throughout the various views. With reference to FIG. 1, shown therein is the preferred embodiment for the simplified present toilet (10). The toilet (10) is substantially an odor-free, water-saving, clog-free environmentally friendly toilet having the following components in combination. The present toilet (10) includes standard components such as associated with most of the prior art, namely a toilet housing (12) having a water closet (14), a toilet seat (16) a toilet bowl (18) and a standard draw and fill flush mechanism (20) for filling and emptying the water closet (14). It is to be understood the standard components (12, 14, 16, 18 & 20) are well known within the prior art and thus the actual workings of each are not taught herein. Also, each of the noted standard components may be made from any suitable materials of engineering choice typically associated therewith. However, each of the standard components may be partially modified as will be seen with the later defined specification.

Figure 2:
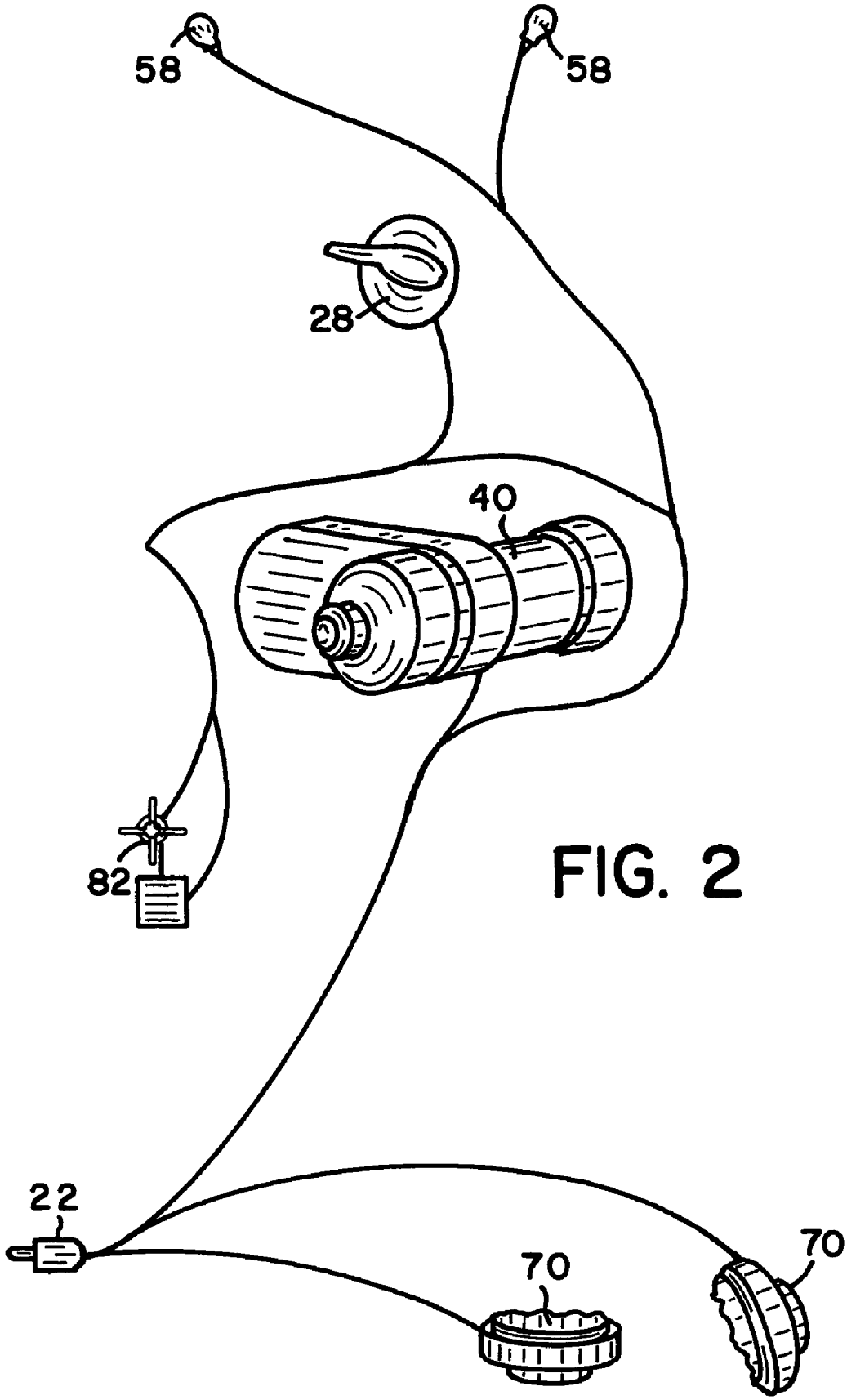
FIG. 2 is substantially an overview of the electrical system associated with the present invention.

Other components of toilet (10) include additional workings not typically associated within the known prior art. For example, toilet (10) further includes an electrical system (22) (depicted in FIG. 2) and as depicted in FIG. 1 a foul air evacuation system (24), a water flow directional system (26) and a three-position handle (28) having an off position, a vacuum position and a power flush position.

In function, when the three-position handle (28) assumes the vacuum position, the electrical system (22) and the foul air evacuation system (24) are automatically actuated. The foul air evacuation system (24) when actuated draws air from around and within the toilet seat (16) and the toilet bowl (18) via a first set of multiple inlet ducts (30) located within the toilet seat (16), a second set of multiple inlet ducts (32) located within the toilet bowl (18), a first internal air directional chamber (34) located within toilet seat (16) and a second internal air directional chamber (36) located within the toilet bowl (18). The foul air is then forcibly directed via vacuum blower inlet duct (38) into a vacuum blower mechanism (40) having a bacterial filter therein for filtering the foul air (not shown for clarity purposes). Thereafter, the vacuum blower mechanism (40) forcibly directs the bacterial free foul air there from via vacuum blower outlet duct (42) into a waste disposal pipe (44) that is in open communication with a sewer line inlet (46). Thereafter, when the three-position handle (28) assumes the power flush position, the standard draw and fill flush mechanism (20) and the water flow directional system (26) are automatically actuated and any waste contained within the toilet bowl (18) is forcibly directed into the waste disposal pipe (44) and then forcibly directed there from into the sewer line inlet (45). It can now be seen within the simplified version of the present toilet (10) foul air is easily removed and dispersed into the sewer system and any waste material deposited into the toilet bowl (18) is easily removed and forcibly directed into the sewer system depending on actuation and position of the three-position handle (28).

Figure 3:
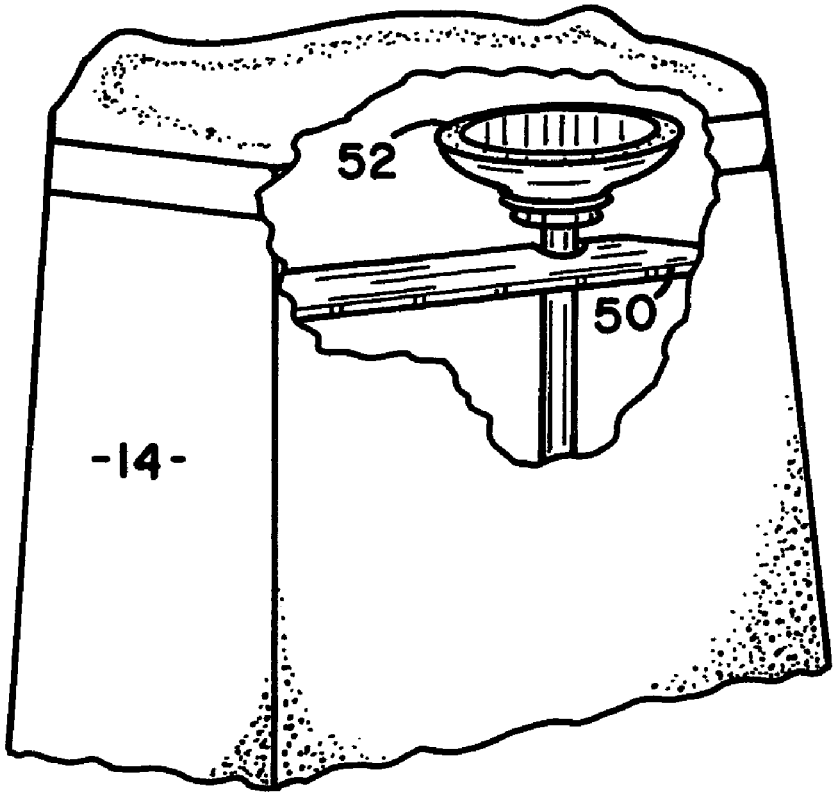
FIG. 3 is substantially a perspective view showing additional optional components

The simplified version of toilet (10) as described above may further include additional options each providing new and unusual results not taught within the known prior art. For example, the toilet (10) may also include a storage compartment (48) that is located within the water closet (14) and maybe used for containment of any suitable items associated with a toilet and it's use. Such items may include toilet paper, hand-wipes, cleaning materials, etc. Yet a further option may be to include an additional compartment (50) for containment of a toilet plunger (52) as depicted in FIG. 3. It is well known that toilet plungers are cumbersome, unsightly and not sanitary. Thus it would be most advantageous to include a compartment for concealed storage thereof. Also, the toilet plunger (52) may be contained within a sanitary ZIPLOCK™ bag or the like and/or it may be of the disposable type.

Yet another option for the present invention is to include a novel fixedly attached toilet paper roll receptacle/dispenser (54) depicted in FIG. 1. It is well known that toilet paper roll/dispensers are usually attached onto a cabinet or other surface closely positioned near the toilet. However, if the toilet paper roll/dispenser were built onto the actual toilet itself this would prove to be most advantageous. Thus the present toilet provides a toilet paper roll receptacle/dispenser (54) formed within/onto the housing (12) at a convenient easily accessible position. Furthermore, the toilet paper roll receptacle/dispenser (54) includes a slidable open/close cover that protects the toilet paper roll from any unsanitary exposure.

Another important optional feature of the present invention is to provide an improved system that greatly increases the flush capabilities and results in a super flush. Whereby, the water flow directional system (26) not only incorporates the standard draw and fill flush mechanism (20) but also includes at least one water line(s) that is/are interconnected to a nozzle(s) (56) for forcibly dispensing water there from into the waste disposal pipe (44).

Still a further optional feature of the present toilet (10) is to provide a night-light (58). It is to be noted any suitable type of night-light may be incorporated depending on user and/or engineering choice. The night-light may be associated and energized by the electrical system (22) associated with FIG. 2 or it may be battery operated such as the night-light depicted in FIG. 1. It is to be noted the actual workings of the night-light are not taught herein as night-lights and their associated components are well known within the prior art. Also, it is to be further noted that the actual housing and its construction are not shown for clarity purposes and as such housings are also known. However, it is contended that the preferred embodiment for the night-light is to include a motion sensor (not shown for clarity purposes) therewith and also the night-light is to be of the "soft glow" variety. This is most important as when an individual awakens during the night it is desirable to have soft lighting so as not to induce a wide-awake situation as after using the toilet the individual will wish to go back to sleep and if they are exposed to bright light during this "sleepy state" sleeping thereafter may be most difficult. As previously noted the night-light should also be a motion sensor so as to automatically illuminate upon detection of movement within the surrounding area of the bathroom and after movement ceases for a pre-determined time, the night-light automatically turns off.

Yet an additional option for the toilet (10) of the present application is to include a compartment (60) for containment of a cleansing chemical, such as bleach or the like, that is automatically discharged upon flushing into the toilet seat (16) and the toilet bowl (18) for automatic cleansing thereof. More importantly (due to gravity and increased flush power) the cleansing chemical further aids to cleanse the waste destruction apparatus (hereafter described) and keep bacterial growth from developing thereon.

Figure 4:
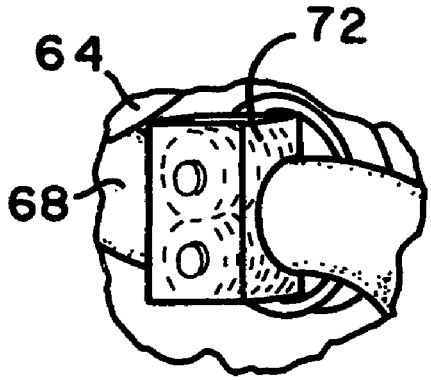
FIG. 4 is substantially an overview of a second waste destruction apparatus.

A most important and novel feature of the present toilet (10) is to include an optional waste destruction apparatus (62) that is removably attached onto the waste disposal pipe (44) via a first coupling member (64) and onto the sewer line inlet (45) via a second coupling member (46). Thus the optional waste destruction apparatus (62) is located yet removably attached in between the waste disposal pipe (44) and the sewer line inlet (45). The waste destruction apparatus (62) includes a housing (68) for attachment thereon and containment of either a removable shredder (70) or a removable slicer (72). Shredder (70) being depicted in FIG. 1 and slicer (72) being depicted in FIG. 4. Both the slicer and shredder are functional for substantial destruction of debris, but in use one or the other may prove to be more functional for different types of waste materials, such as diapers, tampons, menstrual pads, etc. It is to be noted the actual workings of the shredder and slicer are not taught herein as each are manufactured and available for purchase within the field.

It is to be understood the slicer and shredder provide different end results and therefore the end user has the option of which apparatus is more suitable for their personal needs. For example, the shredder is most convenient and functional for almost complete destruction of biodegradable ostomy bags that are currently available on the market. The shredder shreds the ostomy bag and then disposes any remains into the sewer system thereafter. Furthermore, the blades associated with the shredder (70) are positioned at an appropriate angle so as to create a vacuum as well as throwing the debris in a downward motion, resulting in more flushing power which is then further assisted by the spray nozzle(s) (56) for even more flushing power. Therefore, the new and improved toilet (10) of the present invention provides an extremely functional means for disposing and destroying "ostomy bags" and this heretofore has not been available. Until now, ostomy bags (even though they may be biodegradable) tend to clog most systems and this is most inconvenient and even more importantly may cause a health hazard.

Figure 7:
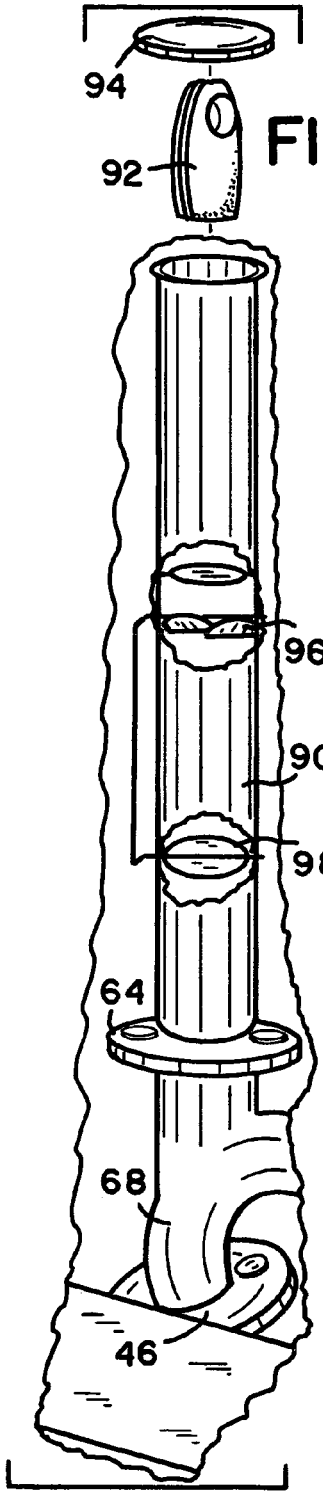
FIG. 7 is substantially a perspective partial view depicting yet a different type of disposal means having an internal drop down disposal shoot.

To further facilitate use by patients having an ostomy, depicted in FIG. 7 is another variant for the construction of the present toilet. Wherein, toilet (10) includes the previously addressed components such as a toilet housing (12) having a water closet (14), a toilet seat (16) a toilet bowl (18) and a standard draw and fill flush mechanism (20) for filling and emptying the water closet (14), electrical system (22) (depicted in FIG. 2) and as depicted in FIG. 1 a foul air evacuation system (24), a water flow directional system (26) and a three-position handle (28) having an off position, a vacuum position and a power flush position. As noted above to further facilitate ease of use by patients having an ostomy, toilet (10) also includes within the water closet (14) an internal drop down disposal shoot (90) that is in line with the waste disposal pipe (44). The internal drop down shoot (90) is designed for disposal of an ostomy bag (92) in a safe environmentally friendly manner and heretofore has not been available.

As depicted in FIG. 7, the drop down shoot (90) includes a removable cap (94) for closure thereof, an air trap that is defined between a first valve assembly (96) and a second valve assembly (98) and is installed and attached by a drop down shoot attachment coupling (99). Valve assemblies (96 & 98) each have an open position and a closed position. Whereby, when the three-position handle (28) assumes the power flush position, each valve assembly (96 & 98) automatically simultaneously assume the open position and when the three-position handle assumes the off position each valve assembly (96 & 98) automatically simultaneously assume the closed position. Thus it can be seen this embodiment allows a patient who has an ostomy to easily dispose of the ostomy bag (92) in a quick and safe manner.

Another very important object and advantage of the present invention is to provide yet another optional accessory for converting the toilet into a medical workstation for use by patients having special needs. More importantly the accessory medical workstation is especially useful for ostomy maintenance, and the like. Thus, the previously taught toilet (10) also includes an externally mounted removable cap (74) (depicted in figure) which when removed allows access into an internal open passageway (76) that is in open communication with the vacuum blower mechanism (40). Whereby, the optional accessory may be easily mounted thereon as follows.

Figure 5:
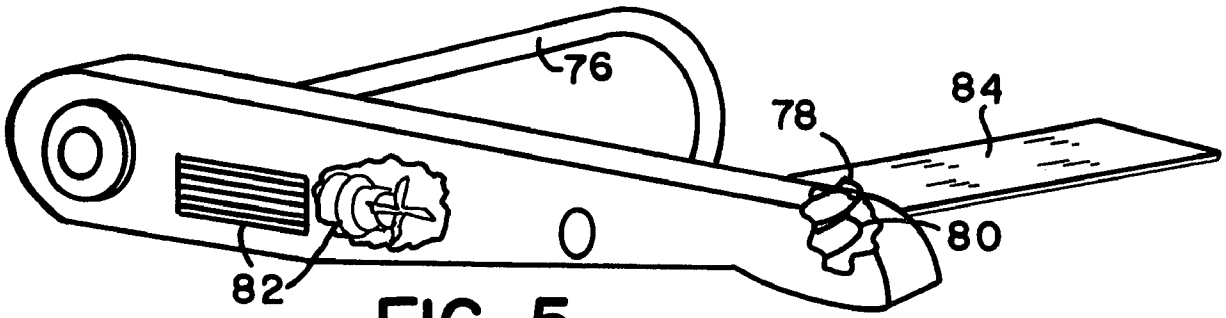
FIG. 5 is substantially a perspective overview of an additional accessory item.
Figure 6:
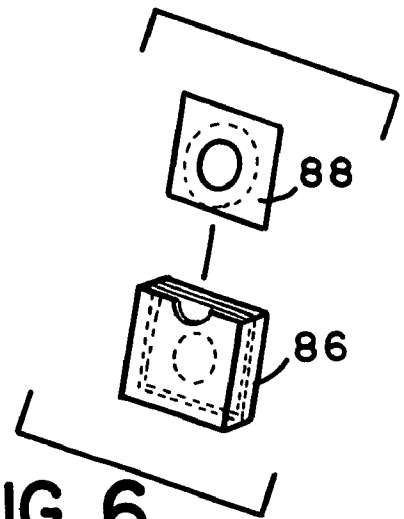
FIG. 6 is substantially a perspective overview of another accessory associated with the accessory of FIG. 5.

Referring now to FIG. 5 wherein the above noted medical workstation is depicted. The medical workstation substantially includes an adjustable arm assembly that is removably attachable onto the internal open passageway (76) when the externally mounted removable cap (74) has been removed. Adjustable arm assembly is rotational between a horizontal position and a vertical position and further provides a vacuum inlet (78) and a hot air outlet (80) with the vacuum inlet (78) being in open communication with the vacuum blower mechanism (40). Whereby, when the vacuum blower mechanism (40) is activated foul air surrounding the vacuum inlet (78) is forcibly drawn into the vacuum blower mechanism (40). Furthermore, the adjustable arm assembly may include a heater/blower element (82) therein which is in open communication with the hot air outlet (80). Whereby, when activated the heater/blower element (82) provides hot air that is forcibly directed outwardly from the hot air outlet (80). More importantly, the adjustable arm assembly further includes a removably attached adjustable transparent shield (84) and when the adjustable arm assembly is in the horizontal position the removably attached adjustable transparent shield (84) when manually positioned extends outwardly horizontally from the adjustable arm assembly at substantially a 90 degree angle and when the adjustable arm assembly assumes the vertical position, the removably attached adjustable transparent shield (84) when manually adjusted assumes a tilted stored position.

The transparent shield (84) is very functional as this not only allows the patient to easily perform the tasks in a hands-free manner, odorless environment but this further allows the user to easily view through the shield while the task is being performed and thus further facilitates ease of use.

The last noted embodiment is very functional for patients attending ostomy matters as this provides most unusual results. Namely, the user can position them selves while on the toilet with the adjustable shield located at a position of user choice. Thereafter, when the foul air evacuation system is activated any foul odors and/or bacteria are automatically easily removed in an environmentally friendly manner. Furthermore, heat is provided and utilized to warm the skin of the user that proves to be most advantages. In use, it has been found the ostomy flanges and the like adhere much better to the skin if the skin is warm when applied and also reduces irritation associated with such. With this in mind another novel feature of the present invention is to also provide upon the adjustable arm a removably attached container (86) for containment of a medicinal member. Whereby, the container (86) when attached is in line with the heater/blower element (82) and the medicinal member is automatically warmed when the heater element and blower actuated. It is to be noted different types of medicinal members of user choice are optional. However, as taught herein the medicinal member is an ostomy flange (88).

Figure 8:
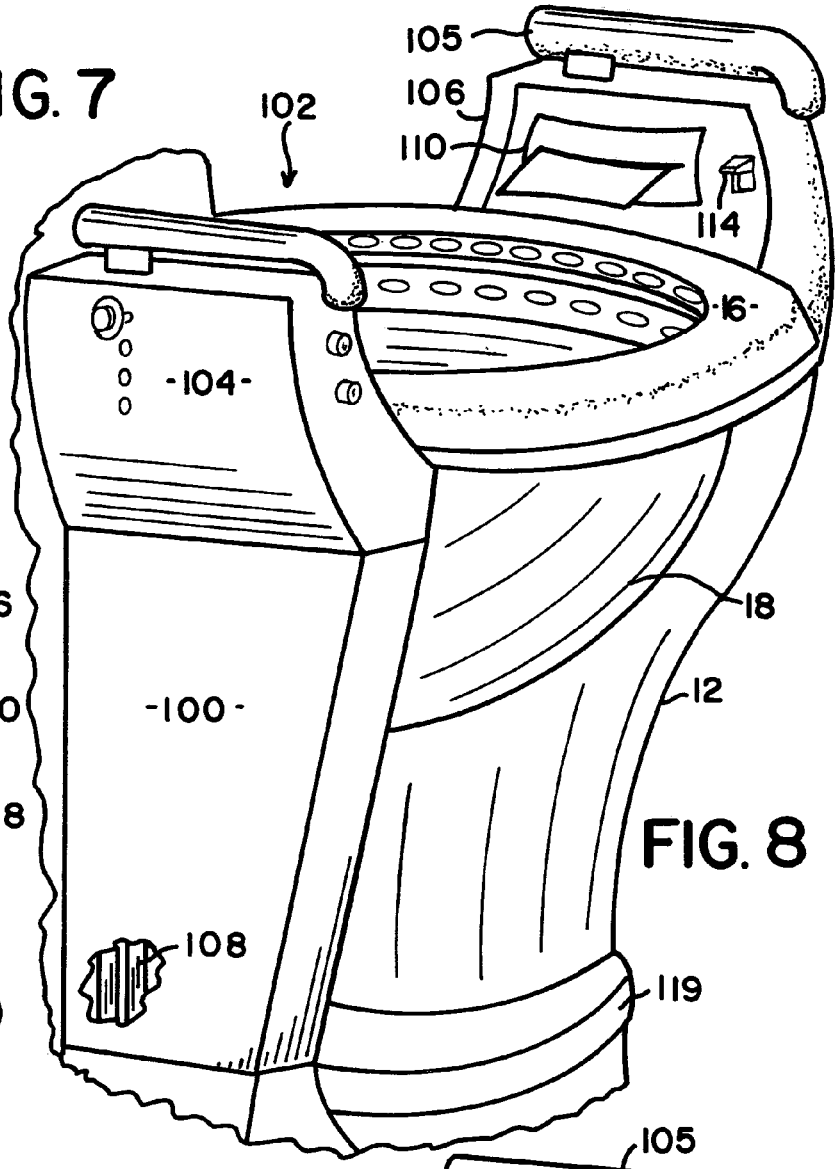
FIG. 8 is substantially a perspective partial view depicting a toilet designed for the handicapped and/or large individuals.

Referring now to FIG. 8 wherein depicted is yet alternative embodiment for the present invention. Namely, a toilet that is especially useful for individuals who are handicapped and/or very large. This is another extremely important consideration as in today's society there are many more obese individuals who have difficulty with a standard sized toilet. Therefore these problems can be resolved with a toilet specifically designed with such individuals in mind. Wherein, the handicapped toilet can be manufactured with only the normal components such as the noted previous components including a toilet housing (12) having a water closet (14), a toilet seat (16) a toilet bowl (18) and a standard draw and fill flush mechanism (20) for filling and emptying the water closet (14). It is to be understood the standard components (12, 14, 16, 18 & 20) are well known within the prior art and thus the actual workings of each are not taught herein. Also, each of the noted standard components may be made from any suitable materials of engineering choice typically associated therewith. However, each of the standard components may be partially modified for use with the handicapped toilet.

Other components of the handicapped toilet (10) may include additional workings not typically associated within the known prior art. For example, toilet (10) further includes an electrical system (22) (depicted in FIG. 2) and as depicted in FIG. 1 a foul air evacuation system (24), a water flow directional system (26) and a three-position handle (28) having an off position, a vacuum position and a power flush position. In the handicapped toilet the three-position switch may be located at a more convenient location, later described. Also, the three-position handle functions in the same manner as previously described.

The handicapped version of toilet (10) as described above may further include the previously additional options. For example, the toilet (10) may also include a storage compartment (48) that is located within the water closet (14) an additional compartment (50) for containment of a toilet plunger (52) as depicted in FIG. 3, a novel fixedly attached toilet paper roll receptacle/dispenser (later described), the water flow directional system (26) and a night-light (58), etc.

Figure 9:
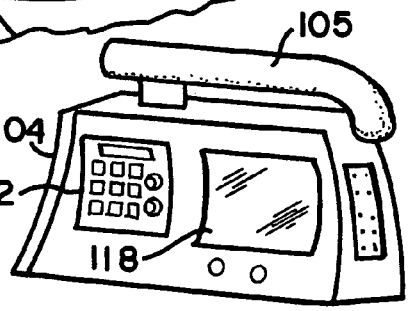
FIG. 9 is substantially a perspective view showing the opposite side of a first arm support associated with the toilet of FIG. 8.

As depicted in FIG. 8, the handicapped toilet (10) includes a more advanced toilet housing (12) namely the toilet bowl (16) includes a first externally molded integrally attached support leg (100) extending to a floor surface and a second externally molded integrally attached support leg (102) shown by an arrow, hidden by housing 12, extending to the floor surface. Each support leg (100 & 102) is identical and are spaced apart and opposed to each other. The handicapped toilet (10) further includes a first body support device (104) and a second body support device (106) with each body support device having a sturdy handgrip (105) thereon. Also, each body support device is removably attachable onto either support leg (100 & 102) depending on user choice. Furthermore, the handicapped toilet wherein each support leg (100 & 102) also includes adjustment means for automatically moving between a first position and second position in both vertical and horizontal directions. The adjustment means may be of any suitable type depending on engineering choice such as mechanical, springs, hydraulics etc. However, one such adjustment means may be an internal hydraulic actuated adjustment device as represented by (108). For convenience and ease of use by either right or left hand users, each body support device provides different optional features. For example, each body support device may include one or a combination of the following. For example, a toilet roll receptacle/dispenser (110) that is fixedly attached, a built in cell phone (112), and/or an optional flush button (114). It is to be noted the built in cell phone (112) may further include a transparent cover for sanitary purposes. It is to be noted that the optional flush button (114) is most convenient as this allows the user easy access and eliminated the need to reach backward or behind them to access the button. Also, the optional flush button (114) is as previously described having a three-position switch having an off position, a vacuum position and a power flush position. Still another optional feature is to include an emergency assistance system (118) having a picture screen that is automatically actuated when the emergency assistance system is activated whereby sending a real-time visual display to an emergence assistance center, such as the well known emergency system Entitled "I.C.E.™" "Information contact Enforcement". It is to be noted FIG. 9 depicts the opposite side of first body support device (104) wherein the above noted features are presented. As further depicted in FIG. 8 the toilet (10) may further include an optional mounting ring (119) for varying the height of the multifunctional odor-free, water-saving, clog-free, environmentally friendly toilet.

It can now be seen herein disclosed is a novel type of new and improved toilet having numerous optional features that are usable by everyone and/or individuals having special physical needs.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. A multifunctional odor-free, water-saving, clog-free, environmentally friendly handicapped toilet comprising: a toilet housing having a water closet; a toilet seat; a toilet bowl; an electrical system; a foul air evacuation system; and water flow directional system; said water flow directional system incorporating a standard draw and fill flush mechanism for filling and emptying said water closet, said standard draw and fill flush mechanism being interconnected and operated by a three position handle having an off position, a vacuum position and a power flush position, when said three position handle assumes said vacuum position, said electrical system and said foul air evacuation system are automatically actuated, said foul air evacuation system when actuated draws air from around and within said toilet seat and said toilet bowl, said foul air is then forcibly directed into a vacuum blower mechanism, said vacuum blower mechanism including a bacterial filter therein for filtering said foul air, said vacuum blower mechanism forcibly directing the bacterial free foul air there from into a waste disposal pipe interconnected to a sewer line, when said three position handle assumes said power flush position, said water flow directional system is automatically actuated and any waste contained within said toilet bowl is forcibly directed into said disposal pipe and then forcibly directed there from into said sewer line, said toilet bowl having a first externally molded integrally attached support leg extending to a floor surface, said toilet bowl having a second externally molded integrally attached support leg extending to said floor surface, each said support leg being spaced apart and opposed to each other, a first body support device, a second body support device, each said body support device being removably attachable onto either said support leg and each said body support device having a sturdy hand grip thereon.

2. The multifunctional odor-free, water-saving, clog-free, environmentally friendly handicapped toilet of claim 1 wherein each said body support device includes adjustment means for automatically moving between a first position and a second position in a vertical direction.

3. The multifunctional odor-free, water-saving, clog-free, environmentally friendly handicapped toilet of claim 1 wherein each said body support device includes adjustment means for automatically moving between a first position and a second position in a horizontal direction.

4. The multifunctional odor-free, water-saving, clog-free, environmentally friendly handicapped toilet of claim 1 wherein one of said body support devices further includes a fixedly attached toilet roll receptacle/dispenser.

5. The multifunctional odor-free, water-saving, clog-free, environmentally friendly handicapped toilet of claim 1 wherein one of said body support devices further includes a built in cell phone.

6. The multifunctional odor-free, water-saving, clog-free, environmentally friendly handicapped toilet of claim 5 wherein said built in cell phone includes a protective transparent cover for sanitary purposes.

7. The multifunctional odor-free, water-saving, clog-free, environmentally friendly handicapped toilet of claim 1 wherein one of said body support devices further includes an optional flush button.

8. The multifunctional odor-free, water-saving, clog-free, environmentally friendly handicapped toilet of claim 7 wherein said optional flush button is a three position switch having an off position, a vacuum position and a power flush position.

9. The multifunctional odor-free, water-saving, clog-free, environmentally friendly handicapped toilet of claim 1 wherein one of said body support devices further includes an emergency assistance system.

10. The multifunctional odor-free, water-saving, clog-free, environmentally friendly handicapped toilet of claim 9 wherein said emergency assistance system further includes a picture screen that is automatically actuated when said emergency assistance system is activated whereby sending a real-time visual display to an emergency assistance center.

11. The multifunctional odor-free, water-saving, clog-free, environmentally friendly toilet of claim 1 further includes an optional waste destruction apparatus that is removably attached onto said waste disposal pipe via a first coupling member and said sewer line via a second coupling member, thus said optional waste destruction apparatus is located yet removably attached in between said waste disposal pipe and said sewer line.

12. The multifunctional odor-free, water-saving, clog-free, environmentally friendly toilet of claim 11 wherein said optional waste destruction apparatus comprising: a housing for containment of either a removable slicer or a removable shredder.

13. The multifunctional odor-free, water-saving, clog-free, environmentally friendly toilet of claim 12 further providing an access door for accessing said optional waste destruction apparatus.

14. The multifunctional odor-free, water-saving, clog-free, environmentally friendly toilet of claim 1 further includes an externally mounted removable cap which when removed allows access into an internal open passageway into said vacuum blower mechanism.

15. The multifunctional odor-free, water-saving, clog-free, environmentally friendly toilet of claim 14 further includes an optional accessory for converting said toilet into a medical workstation comprising: an adjustable arm assembly that is removably attachable onto said internal open passageway when said externally mounted removable cap has been removed, said adjustable arm assembly being rotational between a horizontal position and a vertical position, said adjustable arm assembly having a vacuum inlet and a hot air outlet, said vacuum inlet being in open communication with said vacuum blower mechanism, when said vacuum blower mechanism is activated foul air surrounding said vacuum inlet is forcibly drawn into said vacuum blower mechanism, said adjustable arm assembly having a heater element and a blower therein, said heater element having an on/off switch, said heater element and said blower being in open communication with said hot air outlet, and when said on/off switch is turned on said heater element and said blower are automatically actuated resulting in hot air being forcibly directed outwardly from said hot air outlet.

16. The multifunctional odor-free, water-saving, clog-free, environmentally friendly toilet of claim 15 wherein said adjustable arm assembly further includes a removably attached container for containment of a medicinal member, said removably attached container when attached is in line with said heater element said blower and said hot air outlet, whereby said medicinal member is automatically warmed when said heater element and said blower are actuated.

17. The multifunctional odor-free, water-saving, clog-free, environmentally friendly toilet of claim 16 wherein said medicinal member is an ostomy flange.

18. The multifunctional odor-free, water-saving, clog-free, environmentally friendly toilet of claim 15 wherein said adjustable arm assembly further includes a removably attached adjustable transparent shield, when said adjustable arm assembly is in said horizontal position, said removably attached adjustable transparent shield when manually positioned extends outwardly horizontally from said adjustable arm assembly at a 90 degree angle and when said adjustable arm assembly assumes said vertical position, said removably attached adjustable transparent shield when manually adjusted assumes a tilted stored position.

19. The multifunctional odor-free, water-saving, clog-free, environmentally friendly toilet of claim 1 further includes an internal drop down disposal shoot that is in open communication with said waste disposal pipe and said optional waste destruction apparatus.

20. The multifunctional odor-free, water-saving, clog-free, environmentally friendly toilet of claim 19 wherein said internal drop down disposal shoot includes a removable cap for closure thereof.

21. The multifunctional odor-free, water-saving, clog-free, environmentally friendly toilet of claim 20 wherein said internal drop down disposal shoot includes an air trap defined between a first valve assembly and a second valve assembly, each said valve assembly having an open position and a closed position, when said three position handle assumes said power flush position, each said valve assembly automatically simultaneously assume said open position and when said three position handle assumes said off position each said valve assembly automatically simultaneously assume said closed position.

22. The multifunctional odor-free, water-saving, clog-free, environmentally friendly toilet of claim 1 further including a night-light located externally on said water closet.

23. The multifunctional odor-free, water-saving, clog-free, environmentally friendly toilet of claim 22 wherein said night-light includes a motion sensor, whereby upon detection of motion within the general vicinity said night-light is activated.

24. The multifunctional odor-free, water-saving, clog-free, environmentally friendly toilet of claim 1 further includes an optional mounting ring for varying the height of said multifunctional odor-free, water-saving, clog-free, environmentally friendly toilet.

25. The multifunctional odor-free, water-saving, clog-free, environmentally friendly toilet of claim 1 further including a storage compartment within said water closet.

26. The multifunctional odor-free, water-saving, clog-free, environmentally friendly toilet of claim 1 further including a toilet-plunger containment compartment.

27. The multifunctional odor-free, water-saving, clog-free, environmentally friendly toilet of claim 1 further includes a compartment for containment of a cleansing chemical that is automatically discharged upon flushing into said toilet seat and said toilet bowl for automatic cleansing thereof.

* * * * *